United States Patent [19]

Aoto

[11] Patent Number: 5,022,861

[45] Date of Patent: Jun. 11, 1991

[54] ROTARY ANTENNA CONNECTOR

[75] Inventor: Kozo Aoto, Kawasaki, Japan

[73] Assignee: Nisshin Parts Co., Ltd., Tokyo, Japan

[21] Appl. No.: 534,445

[22] Filed: Jun. 6, 1990

[51] Int. Cl.[5] ..... H01R 39/00

[52] U.S. Cl. ..... 439/13; 403/96

[58] Field of Search ..... 439/13, 318, 319, 321, 439/14–30; 403/96; 285/184, 304

[56] References Cited

U.S. PATENT DOCUMENTS

| | | | |
|---|---|---|---|
| 1,500,132 | 7/1924 | Hummelgard | 403/96 |
| 1,649,951 | 11/1927 | English | 403/96 |
| 2,013,507 | 9/1935 | Schwarz | 439/318 |
| 2,503,281 | 4/1950 | Lynch et al. | 285/184 |
| 3,777,779 | 12/1973 | Schwaller | 285/304 |
| 4,279,176 | 7/1981 | Minamitani | 403/96 |
| 4,548,454 | 10/1985 | Zeller et al. | 439/13 |

FOREIGN PATENT DOCUMENTS

| | | | |
|---|---|---|---|
| 2092392 | 8/1982 | United Kingdom | 439/321 |

*Primary Examiner*—Gary F. Paumen

*Attorney, Agent, or Firm*—Thomas R. Morrison

[57] ABSTRACT

A rotary antenna connector includes a rotary shell rotatably fitted with a stationary shell. A plurality of radial grooves in the stationary shell are engaged by balls resiliently urged between the rotary and stationary shells. Engagement of the balls in the grooves holds an angular position of the antenna connector until the holding force is overcome by sufficient external manual torque.

2 Claims, 1 Drawing Sheet

ROTARY ANTENNA CONNECTOR

BACKGROUND OF THE INVENTION (1) Field of the Invention:

This invention relates to a rotary antenna connector used for portable radio devices and automobile telephone sets.

(2) Description of the Related Art:

A rotatable shell joined unitarily to an antenna is rotatably fitted to a stationary shell. An internal gear is provided on the inner circumferential surface of the rotatable shell, and a corresponding external gear on the outer circumferential surface of the stationary shell. The rotatable shell is normally fixed owing to the meshing of these two gears. When the rotatable shell is pressed against the resilient force of a spring provided therein, these gears are disengaged from each other, and the antenna can be turned by a desired angle. When the rotatable shell is thereafter released from the pressing force, the two gears return to the meshing state by the force of the spring. In another prior art of rotary antenna connectors, a locking projection is provided on a rotatable shell, and a corresponding recess in a stationary shell. The locking projection is normally forcibly fitted in the recess by the resilient force of a spring and maintain the locked state. When the rotatable shell is pulled out forcibly against the force of the spring, the rotatable shell becomes rotatable.

All of these types require operations of pushing or pulling an antenna during a shell rotating operation. In many cases, the antenna is turned directly and the breakage of antenna often occurs.

SUMMARY OF THE INVENTION

A rotatable shell joined unitarily to an antenna is rotatably fitted to a stationary shell fixed to a desired part. A guide shaft at the central portion of the rotatable shell is inserted into a through hole in the stationary shell, and a floating shell rollably containing a plurality of steel balls is mounted slidably on this guide shaft. The floating shell is pressed against the opposed surface of the stationary shell by a coil spring. Semicircular grooves in which the pressed steel balls are fitted are provided radially in the opposed surface of the stationary shell.

BRIEF DESCRIPTION OF THE DRAWINGS

The accompanying drawings show an embodiment of the present invention, wherein.

DETAILED DESCRIPTION OF THE PREFERRED EMBODIMENT

Figure 1:
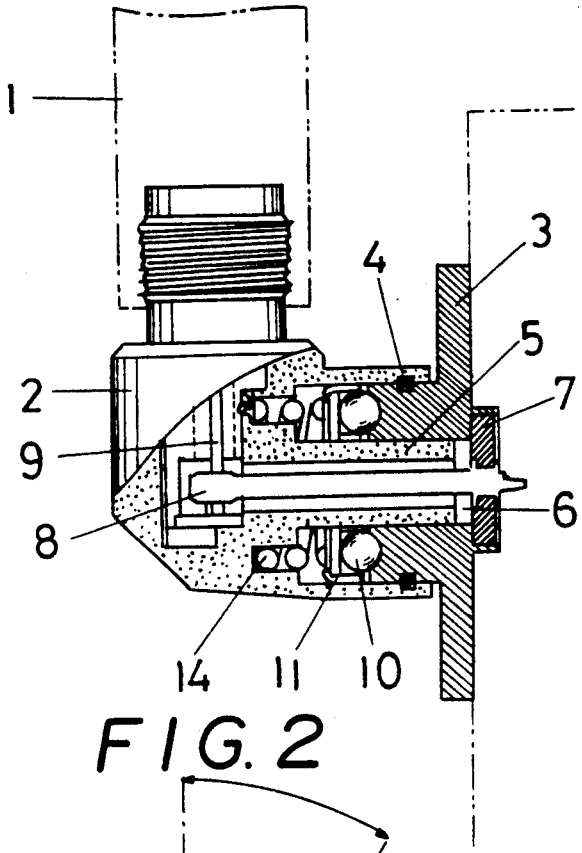
FIG. 1 is a partially cutaway view in the front elevation.
Figure 3:
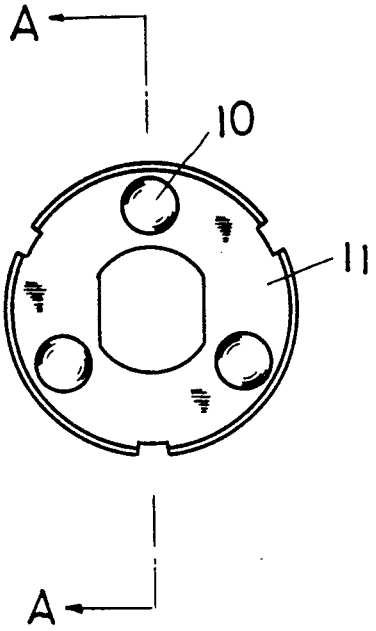
FIG. 3 is a front elevation of a floating shell.
Figure 4:
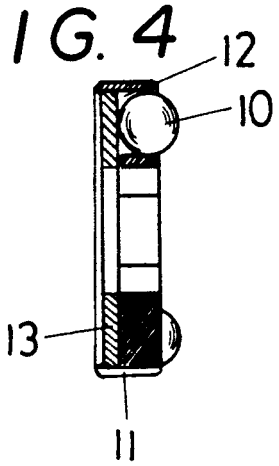
FIG. 4 is a sectional view taken along the line A—A in FIG. 3.
Figure 6:
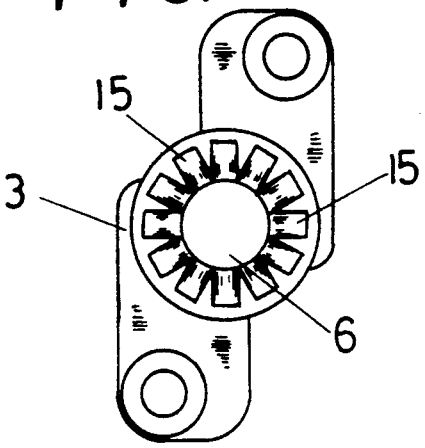
FIG. 6 is a front elevation of the stationary shell.

A rotatable shell 2 joined unitarily to a rod antenna 1 is turnably fitted around a stationary shell 3 fixed to a desired portion of a portable telephone. An annular keyway is provided in the inner circumferential surface of the slidingly rotatable shell 2 and the outer circumferential surface of the stationary shell 3, and a ring key 4 is inserted therein to restrict the axial relative motion of these shells. A guide shaft 5 of the rotatable shell 2 is fitted in a through hole 6 in the stationary shell 3, and a panel contact 8 joined unitarily to the stationary shell 3 is inserted into the guide shaft 5 via an insulating panel 7. The panel contact 8 is engaged constantly with a turnable antenna contact 9. The outer circumferential surface of the hollow guide shaft consists of curved and flat portions, and is ground precisely to predetermined dimensions. A floating shell 11 containing a plurality of steel balls 10 so that these balls can be rolled is fitted slidably around the guide shaft 5. Each of three ball support holes 12 made in the equiangularly spaced portions of the floating shell 11 is drawn at its front end portion slightly in the inward direction, and the steel balls 10 are inserted in the ball support holes 12. A washer 13 is then applied the rear ends of these steel balls 10. An annular projection on the rear end of the floating shell 11 is also drawn inward to cause the steel balls 10 to project forward partially, the balls 10 being thus rollably held (FIG. 4). The floating shell 11 which can be moved axially along the guide shaft 5 is fitted with zero backlash with respect to the guide shaft 5. Therefore, the curved and flat portions constituting the inner circumferential surface of the floating shell 11 are ground to precise shapes and dimensions just as the outer circumferential surface of the guide shaft 5. This float shell 11 is pressed against the opposed surface of the stationary shell 3 by a coiled spring 14, and cross-sectionally semicircular grooves 15 in which the steel balls 10 are partially fitted are provided radially in the opposed surface of the stationary shell 3 (FIG. 6). The pressing force applied to the steel balls 10 pressed against the cross-sectionally semicircular grooves 15 is so set to a level as to keep the steel balls 10 in a locked state even when the rod antenna 1 is vibrated, and to be moved to the adjacent arcuate grooves 15 speedily when a torque of not lower than a certain level is transmitted to the floating shell 11.

The operation of the present invention will now be described. In the rotatable shell 2 the axial movement of which is restricted by the ring key 4, the coiled spring 14 contained therein presses the floating shell 11 against the stationary shell 3. The steel balls 10 held in the floating shell 11 are pressed forcibly into the semicircular grooves 15 in the stationary shell 3. Since the floating shell fitted precisely around the guide shaft 5 is a fixed (locked), the rotatable shell 2 and rod antenna 1 which are combined unitarily with the guide shaft 5 are also kept fixed.

Figure 2:
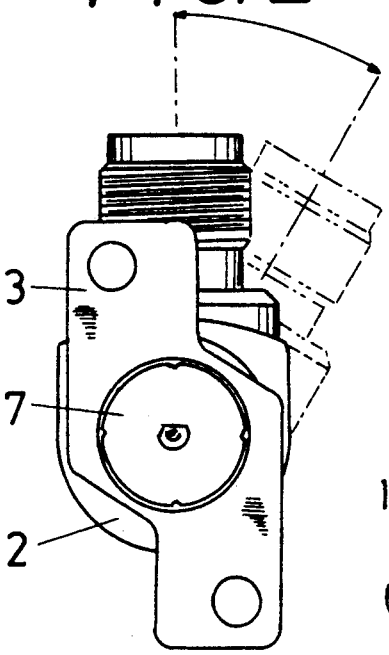
FIG. 2 is a right side elevation.
Figure 5:
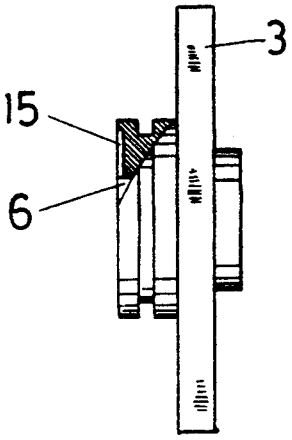
FIG. 5 is a partially cutaway view in the side elevation of a stationary shell.

When a torque is applied to the rotatable shell 2 so as to vary the angle of the rod antenna 1, the steel balls 10 move and rise along the surfaces of semicircular grooves 15 to cause the floating shell 11 to move in the axial direction of the guide shaft 5 against the resilient force of the coiled spring 14 and the steel balls 10 move to the adjacent grooves as they roll in their ball support holes 12. As a result of this operation, the rod antenna 1 is inclined 30° (FIG. 2) because the angular distance between the adjacent arcuate grooves 15 is 30° in this embodiment (FIG. 6). In a conventional rotary antenna connector consisting of a combination of a locking projection and a recess, it is necessary, when the projection is displaced, to apply an axial projection-unlocking force to the antenna connector, and thereafter to apply a torque thereto. According to the present invention, since the rollable steel balls 10 move up easily on the surfaces of the cross-sectionally semicircular grooves 15, only a torque is applied to the rod antenna 1. The structure that the floating shell 11 rollably holds the steel balls 10 is one of the characteristics of the present invention.

According to the present invention, the floating shell 11 rollably holding the steel balls 10 is fitted precisely around the guide shaft 5, which is combined unitarily with the rotatable shell 2, in such a manner that the floating shell 11 can be axially moved, and the steel balls 10 are pressure forcibly by the coiled spring 14 against the semicircular grooves 15 provided radially in the opposed surface of the stationary shell 3. Therefore, operation of adjusting the angle of the antenna can be carried out by simply turning the antenna to a desired rotational position. This enables the operation efficiency to be markedly improved. Since the rotatable shell 2 is fitted around the stationary shell 3 with the movement of the former shell restricted by the ring key 4, the two shells are combined more tightly. Accordingly, a rattle-free high-quality rotary antenna connector can be obtained.

What is claimed is:

1. A rotary antenna connector comprising:

a rotatable shell;

said rotatable shell including means for permitting a unitary connection to an antenna;

a stationary shell;

means for slidably fitting said rotatable shell upon said stationary shell, and for permitting rotational relative motion therebetween;

a first plurality of balls retained in a floating shell disposed between said rotary shell and said stationary shell;

a second plurality of grooves on an opposed surface of said stationary shell;

said balls facing said grooves; and resilient means for urging said balls partially into said grooves;

said floating shell includes a first plurality of generally round holes therein for retaining said first plurality of balls in relatively fixed angular positions.

2. A rotary antenna connector according to claim 1, wherein said resilient means for urging includes a spring applying force on said floating shell.

* * * * *